United States Patent [19]

Wicks et al.

[11] Patent Number: 5,068,671

[45] Date of Patent: Nov. 26, 1991

[54] ORTHOGONALLY POLARIZED QUADRAPHASE ELECTROMAGNETIC RADIATOR

[75] Inventors: Michael C. Wicks, Utica; Paul V. Etten, Clinton, both of N.Y.

[73] Assignee: The United States of America as representated by the Secretary of the Air Force, Washington, D.C.

[21] Appl. No.: 218,198

[22] Filed: Jun. 24, 1988

[51] Int. Cl.[5] ..... H01Q 21/20; H01Q 1/48

[52] U.S. Cl. ..... 343/799; 343/846

[58] Field of Search ..... 343/705, 708, 797–799, 343/846, 899, 908

[56] References Cited

U.S. PATENT DOCUMENTS

| | | | |
|---|---|---|---|
| 2,581,352 | 1/1952 | Bliss | 250/33.65 |
| 3,811,127 | 5/1974 | Griffee et al. | 343/846 |
| 3,919,710 | 11/1975 | Fletcher et al. | 343/770 |
| 3,942,180 | 3/1976 | Rannou et al. | 343/725 |
| 3,987,458 | 10/1976 | Reggia et al. | 343/846 |
| 4,010,470 | 3/1977 | Jones, Jr. | 343/708 |

*Primary Examiner*—Gregory C. Issing

*Attorney, Agent, or Firm*—Gerald B. Hollins; Donald J. Singer

[57] ABSTRACT

A broadband multi-element antenna having desirable phase, standing wave and polarization characteristics is disclosed. The antenna is arranged as a plurality of airfoil shaped elements located in radial planes about a central axis with the element peripheries collectively defining a horn shaped surface—centrally disposed of which is a ground plane member of preferably truncated conical shape which includes electrical feeding arrangements having in phase and out of phase element coupling. The antenna is suitable for radar, satellite, and other precision uses including military applications.

23 Claims, 11 Drawing Sheets

ORTHOGONALLY POLARIZED QUADRAPHASE ELECTROMAGNETIC RADIATOR

RIGHTS OF THE GOVERNMENT

The invention described herein may be manufactured and used by or for the Government of the United States for all governmental purposes without the payment of any royalty.

CROSS-REFERENCE TO RELATED APPLICATIONS

The present document relates more or less to three earlier filed statutory invention registration documents which originated with the same two inventors and which are assigned to the same assignee as the present application. The three earlier documents titled, "The Polarization Diverse Phase Dispersionless Broadband Antenna", Ser. No. 841,375; "The Mono-Blade Phase Dispersionless Antenna", Ser. No. 841,376; and "The Bi-Blade Century Bandwidth Antenna", Ser. No. 841,381; were filed on Feb. 21, 1986. The disclosure of these three earlier documents is hereby incorporated by reference into the present document.

BACKGROUND OF THE INVENTION

This invention relates to the field of electromagnetic wave antenna apparatus of the large bandwidth, diverse polarization and phase dispersionless type.

The prospect of replacing a plurality of single purpose antennas for a modern military aircraft with a lesser number of antennas that are capable of wideband and multi-functional operation is of significant interest in the aircraft and electronic arts. For reasons which include space availability, maintenance simplification and improved aerodynamic characteristics, the prospect of aircraft and spacecraft antenna count limitation is now carefully considered in the planning of each new aircraft and space vehicle and in each modification of existing equipment. The broadband radiation capability of the presently disclosed antenna together with its desirable polarization and phase characteristics suggest the possibility of its service in such applications. The antenna of the present disclosure can also be arranged for use in other environments such as satellite communications—in both the orbital vehicle and the earthbound receptor functions. In the latter, earthbound satellite receptor use the antenna herein disclosed can be supplemented with a parabolic dish or other reflecting element arrangements.

The prior patent art includes a large number of antenna arrangements, however, the characteristics of these antennas do not include the desirable bandwidth, phase, and polarization characteristics—especially the combination of these characteristics found in the present invention antenna.

The difficulty encountered in simultaneously achieving a combination of no phase dispersion with desirable spatial pattern and bandwidth characteristics in a single antenna is demonstrated by the commonly accepted compromises which lead to use of the log periodic antenna and the cavity backed spiral antenna. Each of these antennas can be arranged to achieve bandwidths exceeding a decade while also providing respectable spatial patterns and relatively desirable radiation efficiency. Along with these desirable properties, however, these antennas are known to have undesirable voltage standing wave ratios, values in the range of 2 to 1 or greater and to also exhibit severe time or phase dispersion of a transmitted or received signal. Such antennas, if fed with a very short pulse of radio frequency energy, a pulse of less than several cycles duration, provide a radiated electromagnetic waveform which contains severe phase and time dispersion effects and thereby cause the radiated waveform to be stretched in time. The combination of non-dispersion and broad frequency band characteristics is particularly unusual in the present state of the antenna art. For use in the spread spectrum signal environment and other broadband applications therefore, an improved antenna such as disclosed herein, is needed—especially in the specialized field of antennas for military use.

SUMMARY OF THE INVENTION

The antenna of the present invention involves a multi-bladed structure wherein active antenna radiating elements are oppositely disposed around a central ground plane member and are electrically coupled to a signal source or signal reception apparatus according to a selected element phasing arrangement. The antenna of the invention provides notably improved phase, bandwidth, and dispersionless operating characteristics.

It is therefore an object of the present invention to provide an antenna that is capable of wideband, multi-octave signal spectrum performance.

It is another object of the invention to provide an antenna that is capable of transmitting and receiving signals of diverse polarization, polarizations which include linear, circular and elliptical polarization patterns.

It is another object of the invention to provide an antenna that is capable of high fidelity, phase dispersionless operation over a wide frequency band.

It is another object of the invention to provide an antenna capable of achieving the aforementioned three objects simultaneously.

It is another object of the invention to provide an antenna which can be adapted to wideband operation in a plurality of different frequency spectrum ranges including, for example, the microwave spectrum, the high frequency spectrum and in the intervening frequency bands.

It is another object of the invention to provide an antenna having a low radar cross-section, an antenna which is therefore suitable for use in military vehicles.

It is another object of the invention to provide an antenna that is capable of replacing a plurality of existing antennas in selected applications.

It is another object of the invention to provide an antenna that is suitable for mounting in the nose cone of an aircraft or missile.

It is another object of the invention to provide an antenna that is capable of use as a radar tracking antenna, as an electronic support measures (ESM) antenna or as an electronic intelligence (ELINT) system antenna.

It is another object of the invention to provide a high precision antenna which may be used in laboratory calibration.

It is another object of the invention to provide an antenna which operates with a low input voltage standing wave ratio, a ratio in the range of 1.1 to 1 or less.

It is another object of the invention to provide an antenna which operates in the non-resonant broad frequency band mode of operation.

It is another object of the invention to provide an antenna which is simple to construct and inexpensive to manufacture.

It is another object of the invention to provide an antenna which is relatively small in comparison with its achieved electrical properties.

Additional objects and features of the invention will be understood from the following description and the accompaning drawings.

These and other objects of the invention are achieved by an antenna apparatus which includes the combination of a tapering-shaped ground plane element disposed around an antenna central axis with an apex portion thereof facing a first axis extremity and a base portion thereof facing the opposite axis extremity, a plurality of plane radiator elements disposed in radial planes that are symmetrically distributed about the axis and orthogonally oriented with respect to the surface of the ground plane element, each of the radiating elements extending along the axis beyond the ground plane apex portion in the direction of the first axis extremity and having a curving cross-sectional shape in its plane of residence including predetermined varying separation between the radiating element axis adjacent edge thereof and the ground plane surface.

DETAILED DESCRIPTION

Figure 1:
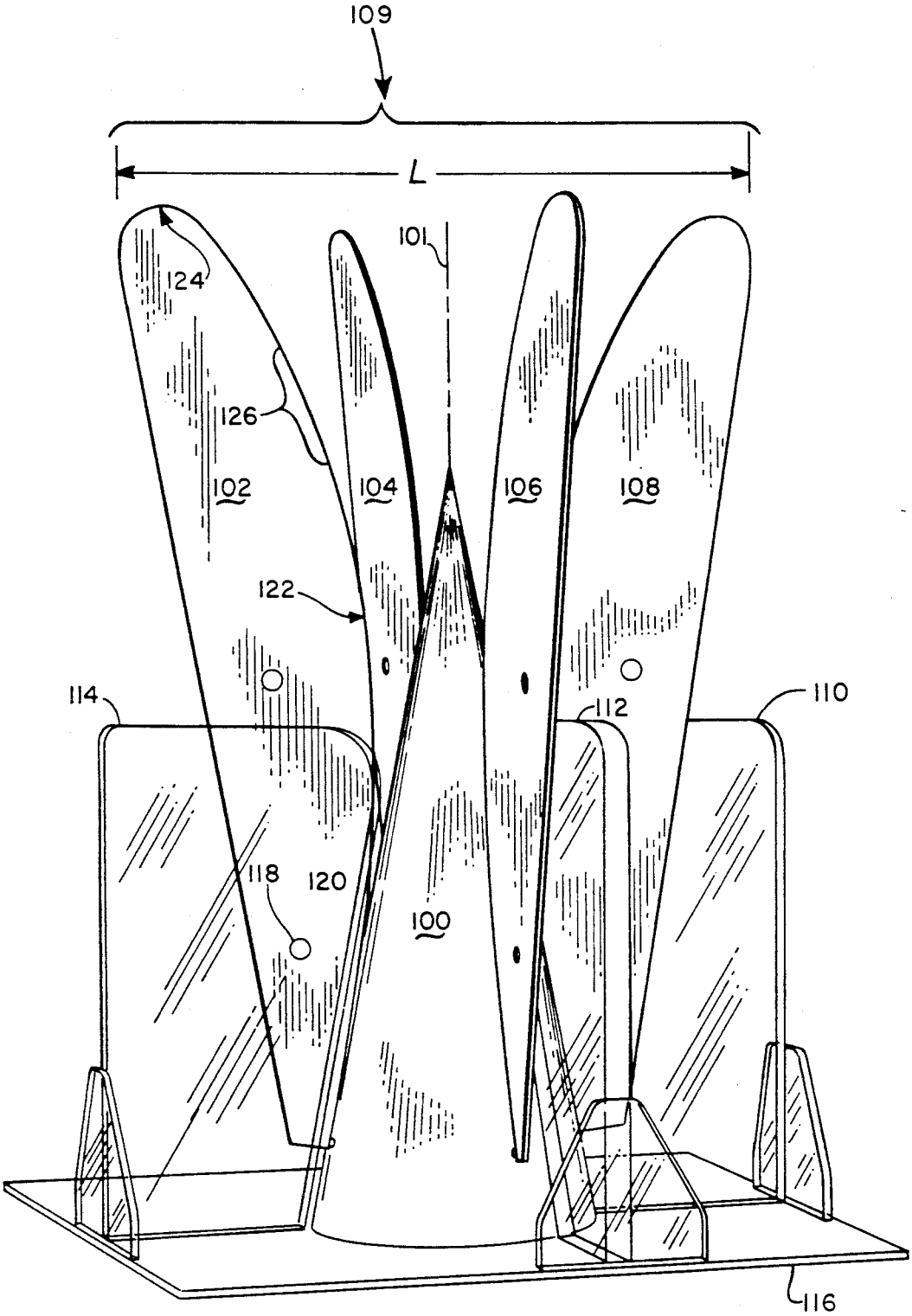
FIG. 1 is an overall perspective view of an antenna embodied according to the present invention.

FIG. 1 in the drawings shows an overall perspective view of an antenna 109 that is made in accordance with the present invention. The FIG. 1 antenna 109 includes a truncated cone shaped member 100 which serves as a ground plane element for the antenna. Surrounding this conical ground plane element is an array of antenna radiating elements, which are four in number in the FIG. 1 antenna; the radiating elements are denoted by the identifying numbers 102, 104, 106 and 108.

The conical ground plane element 100 in the FIG. 1 antenna is presumed to be symmetrically disposed about a central axis 101 which passes through the top most or apex portion of the conical ground plane element and extends through the center of the bottom truncation circle of the conical ground plane element. The radiating elements 102, 104, 106 and 108 in the FIG. 1 antenna are disposed radially with respect to the central axis 101. For description convenience, each of the radiating elements 102, 104, 106 and 108 can be considered to reside in a radiating element plane which passes through or incorporates the central axis 101.

Also shown in FIG. 1 is one arrangement of an element supporting structure which may be used to retain the radiating elements 102–108 in fixed predetermined positions with respect to each other and with respect to the conical ground plane element 100. This supporting structure includes a base member 116 and radiating element support arms 110, 112 and 114. Attachment between the radiating elements 102–108 and the support arms 110–114 may be accomplished by way of machine screws or the like, preferably electrically non-conductive machine screws such as are fabricated from nylon or phenolic or other electrical insulation materials. The base member 116 and the support arms 110–114 may also be fabricated of clear acrylic or phenolic or other non-conducting materials which have good electrical properties in the frequency range selected for the FIG. 1 antenna; clear acrylic composition of these elements is presumed in FIG. 1—hence the resulting see through representation of the supporting structure elements in FIG. 1.

The shape shown in FIG. 1 for each of the radiating elements 102–108 may be described as having resemblance to the cross-section of an airfoil member since the illustrated element shape includes a rounded leading edge, a somewhat flattened "lower surface", a humped curving "upper surface", and a tapered trailing edge region, these regions face upward, outward, inward, and downward respectively, in the FIG. 1 antenna 109. This airfoil like shape is desirable in the present invention for the electrical impedance and radiating characteristics achieved by the humped curving element shape in combination with the conical ground plane element 100. The portions of the curving shape indicated at 120, 122, and 124 in FIG. 1 are principally determinative of the radiating element electrical characteristics with each of these portions especially affecting selected portions of the overall electrical characteristics as is described in detail below.

The radiating elements 102, 104, 106 and 108, may also be described as cross-sectional elements of a horn structure. In the FIG. 1 antenna 109, the throat, mouth, and tip regions of the element defined horn are located at the lower mid and upper portions of the FIG. 1 displayed elements.

Figure 2:
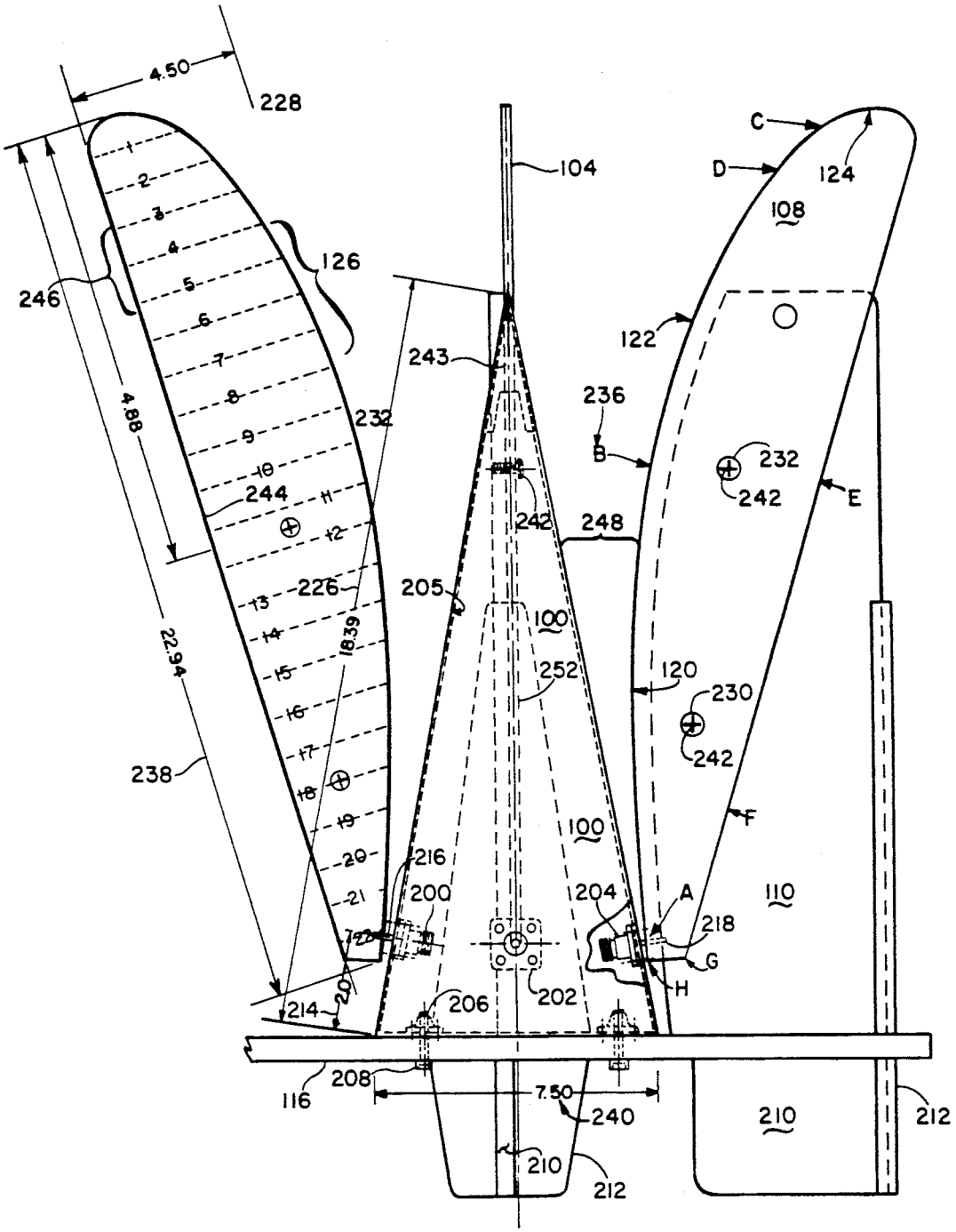
FIG. 2 is a cutaway partial view of an antenna embodied according to the present invention including structure and dimension details.

FIG. 2 in the drawings shows additional details of selected elements from the FIG. 1 antenna. In FIG. 2, several of the identifying numbers used in FIG. 1 are repeated where appropriate for FIG. 1 shown elements with new members in the 200 series being employed for elements first shown in FIG. 2. The FIG. 2 representation of the FIG. 1 antenna is shown in a slightly rotated from head-on condition for drawing convenience and therefore, appears somewhat asymmetric in shape. The repeated elements and numbers in FIG. 2 include the radiating element 108, the conical ground plane 100, the radiating elements support arm 110, the base member 116 and the blade element curvature indications at 120, 122, and 124, that is, the curvature indications at the throat, midpoint, and horn mouth or airfoil leading edge regions of the antenna radiating element 110.

Additional details shown in FIG. 2 of the drawings include three of the four coaxial connector fittings by which electrical signals traveling to or from the antenna elements 102, 104, 106 and 108 are communicated through the electrically conductive surface of the conical ground plane member 100. These coaxial cable fittings are shown at 200, 202 and 204 in the FIG. 2 drawing. As is indicated at 216 and 218 for the fittings 200 and 204, each fitting includes an electrically insulated center conductor by which electrical signal is conveyed through the copper or aluminum or similar conductive sheet 205 of the coaxial ground plane element 100 to the antenna elements. Electrical and physical connections between the center conductor and the antenna elements are made by way of a mating female aperture 218 located in each of the radiating elements 102, 104, 106 and 108. The coaxial cable fittings 200, 202 and 204 therefore, serve as both a portion of the physical structure of the antenna 109 and also serve as terminating fixtures for the coaxial cable transmission line elements used in coupling electrical signals with the radiating elements 102–108. Also shown in FIG. 2 are representative threaded fastener members 206 and 208 by which the conical ground plane element 100 is removably attached to the base member 116. Additionally shown in FIG. 2 are radiating element supporting and bracing elements 212 and 210, the bracing element portion of these structures being located below the base member 116.

The location of the coaxial cable fittings 200, 202, and 204 is indicated at 214 in FIG. 2; the indicated dimension is appropriate for each of the four coaxial fittings of the FIG. 1 and 2 antenna. Significant overall dimensions for the major elements of the FIG. 1 and 2 antenna, dimensions which are applicable to a microwave band embodiment of the antenna—an antenna usable over the band generally extending between frequencies of 0.5 gigahertz and 18 gigahertz are shown at 226, 228, 238 and 240 in FIG. 2. The dimensions in FIGS. 1 and 2 are shown in inches.

The apex portion of the conical ground plane element may be fabricated as a part of the conductive sheet material 205 or alternately may be fabricated as an integral unit 243 which is inserted into the ground plane element during fabrication. At 230, 232 and 234 in FIG. 2, are shown three mounting holes which may be used for maintaining the radiating element 108 in a fixed rigid position by attachment to the radiating element support arm 110, for example—using such attachment arrangements as the threaded screws 242 which are also shown in FIG. 2. Preferably, the threaded screws 242 are made of nylon or some other electrically non-conducting material.

An additional series of radiating element region identifiers are indicated by the letters A through H shown at 236 in FIG. 2. The region identifiers 236 are used herein in connection with the surge impedance characteristics and the curve of FIG. 3 in the drawings and are discussed below.

Additional details of the FIG. 1 and 2 antenna that are identified in FIG. 2 include the radiating element back edge or airfoil underside edge 244, and the series of chord line identifying numbers, numbers between one (1) and twenty-two (22) which are indicated at 246 in FIG. 2. A list of radiating element dimensions along each of the chord lines indicated at 246 in FIG. 2 and applicable to the herein described microwave frequency band embodiment of the antenna invention is presented below as Table 1.

TABLE I

Radiating Element Chord Line Dimensions for Microwave Band Antenna 22.94 inch overall length

| FIG. 2 Chord Line Number | Chord Length Dimension |
|---|---|
| 1 | 2.44 |
| 2 | 3.00 |
| 3 | 3.38 |
| 4 | 3.70 |
| 5 | 3.90 |
| 6 | 4.18 |
| 7 | 4.34 |
| 8 | 4.46 |
| 9 | 4.50 |
| 10 | 4.48 |
| 11 | 4.42 |
| 12 | 4.30 |
| 13 | 4.12 |
| 14 | 3.90 |
| 15 | 3.60 |
| 16 | 3.38 |
| 17 | 3.10 |
| 18 | 2.98 |
| 19 | 2.14 |
| 20 | 2.10 |
| 21 | 1.72 |
| 22 | 1.34 |

In addition to chord lengths in FIG. 2, Point A is ⅛ inch from Point H.

Since the antenna of the present invention is intended for use with broadband transmission or reception apparatus rather than with the conventional continuous wave single frequency apparatus, many of the theorectical and mathematical concepts used to describe antennas and their electrical characteristics are no longer useful tools in a technical discussion and are more conveniently replaced by concepts which have meaning over wide frequency ranges. Among the concepts includable in this change of descriptive concepts is the familiar characteristic impedance. The concept of characteristic impedance is often used to describe radio frequency hardware such as antennas, transmission lines, and networks but is principally useful at one frequency in the continuous wave or CW operating realm. The characteristic impedance of a transmission line is the driving-point impedance which the line would have if it were of infinite length. However, it is recommended that this term be applied only to lines having approximate electrical uniformity. For wide frequency band antennas and their associated apparatus, the concept of surge impedance is more useful than measurements of characteristic impedance. Surge impedance is therefore used when considering transmission lines and other apparatus designed for broadband applications. The term surge impedance is, therefore, employed herein for describing inter alia the tuning or shaping or refining of the radiating elements 102, 104, 106 and 108 and their spacing 248 from the conical ground plane element 100 and from each other. Values of surge impedance can be measured in a laboratory setting with an apparatus called a time domain reflectometer. One version of a time domain reflectometer, an apparatus which may be used in connection with the present invention antenna is the model HP54120T reflectometer made by Hewlett Packard Corporation.

Figure 11:
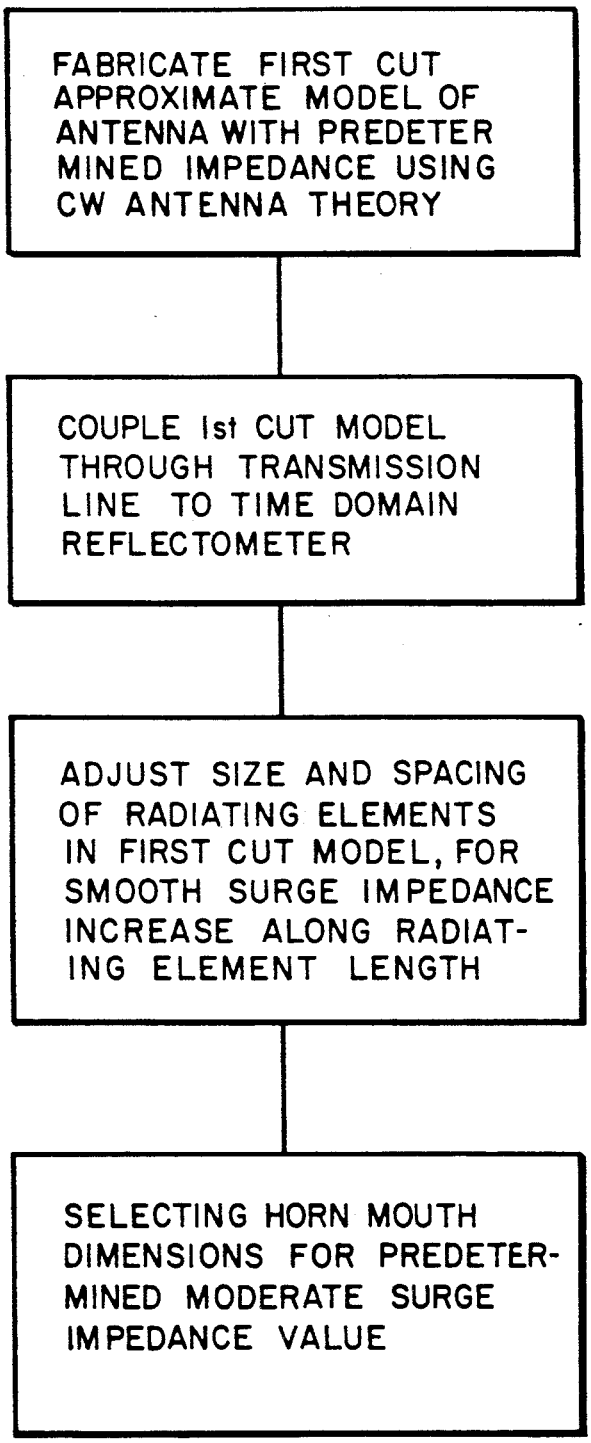
FIG. 11 shows a sequence of steps which may be used to fabricate and tune an antenna in accordance with the invention.

A procedure for the empirical selection of radiating element size, shape, and spacing parameters using a time domain reflectometer or similar instrument and the concept of surge impedance is shown in FIG. 11 of the drawings. Generally, this fabrication procedure assumes the presence of an initial cut or try at the antenna—an antenna which may be arrived at from the designers previous experience and from conventional continuous wave antenna theory together with a consideration of the aircraft space allocation and shape configuration in the case of airborne antennas. This initial cut antenna may involve, for example, radiating elements formed of wire screening, copper foil or other conveniently workable materials. With this initial cut of the antenna, time domain reflectometer measurements can be made. Preferably, such measurements are made through a length of coaxial transmission line selected to achieve an impedance match with the signal source or receiver.

The feed region of the radiating element 108 in FIG. 2, the region identified with the letter A, is preferably arranged to having a surge impedance of 50 ohms in order that a well matched coupling with common coaxial cable characteristics be possible. The configuration of the feed region of the radiating elements can be approximated theoretically by regarding the spacing 248 between the radiating element 108 and the ground plane element 100 in FIG. 2 as the slot portion of a slot radiator—a radiator which is then analyzed according to the concepts presented in of the text "Antenna Engineering Handbook" by Richard C. Johnson and Henry Jasik, 2nd Edition, 1984, McGraw-Hill Book Company. Both the Chapter 8 Slot Antenna and the Chapter 9 Slot Antenna Arrays Materials from the Johnson and Jasik text are helpful in the initial configuration of radiating element 108 and its spacing 248. The disclosure of the Johnson and Jasik text is hereby incorporated by reference herein.

Theorectical consideration and the initial cut of an antenna according to the invention can also utilize the conceptual dual of a single radiating element antenna. According to the dual concept, when a radiating element is located above a metal ground plane, the dual of this element appears below the ground plane and image theory provides a tool for analyzing the resulting properties. Removal or alternately shrinking of the ground plane cone in the FIG. 2 antenna until only two radiating elements remain is included in an analysis of this type. Transmission line slot theory may then be applied to these remaining two elements and their spacing. The slot width may be presumed to open exponentially from the throat to the mouth regions of the FIG. 1 and 2 elements with the radiating element end opposite the feed point considered as a constant radius arc. A slot radiator of this type has a transverse electromagnetic mode (TEM) of propagation.

Figure 3:
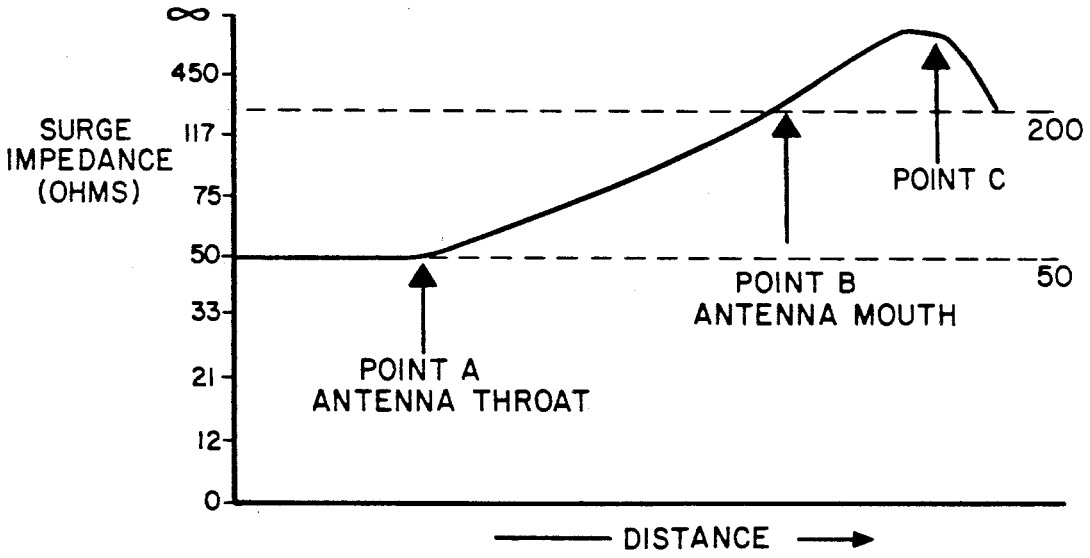
FIG. 3 shows a desired surge impedance vs. distance characteristic for an antenna made in accordance with the invention.

As indicated in the second and third blocks of FIG. 11, the block 1 initial cut antenna may be refined through the use of surge impedance measurements achieved with a time domain reflectometer or similar measurement instrument. A desirable configuration of the surge impedance characteristics of the FIG. 1 and FIG. 2 antenna elements is shown in FIG. 3 of the drawings. The above indicated value of 50 ohms for the surge impedance at the element feed point, point A in the region identifiers 236 of FIG. 2, is also identified as point A in FIG. 3. Commencing with this feed point impedance, a smoothly increasing value of surge impedance progressing from feed point through the throat 120, mid region 122, and leading edge region 124, that is, through the points B and C in FIG. 3 is desired.

As indicated above, the radius of the element 108 at the airfoil leading edge or open end of the horn shape in FIG. 2, desirably lies between a too small radius value wherein excessive slope and unwanted energy feedback to the input or point A region of the radiating element horn occurs and a too large radius value wherein the physical size of the antenna becomes excessive. The radiating element backside configuration, that is, the geometry of the element 108 along the points designated as D, E, and F in FIG. 2 is somewhat optional with respect to antenna electrical characteristics and may be disposed in the form of a substantially straight line as indicated in FIG. 2 or otherwise arranged according to structural or other considerations. A long length for the FIG. 2 antenna, together with the relatively slow change of surge impedance as illustrated in the FIG. 3 drawing is desirable in order to realize a low voltage standing wave ratio characteristic for the antenna.

A low voltage standing wave ratio is desirable not only for its usual benefits of minimizing electrical stresses in transmitting apparatus and maximally coupling radio frequency energy into the antenna and to free space, but also in order that a reduced radar cross-section obtain for the antenna. A low radar cross-section is clearly desirable for military uses of antennas made in accordance with the invention as may be surmised from the currently announced interest in stealth aircraft.

The optimum location of the feed point and the aperture 218 with respect to the radiating element 108 in FIG. 2 is one which avoids a "bump" or other irregularities in the surge impedance relationship shown in the FIG. 3 drawing. In addition to location of the feed point according to this criteria, it is desirable for electromagnetic field fringing effects to be avoided in the A, H, and G region of the antenna radiating element 108. A major consideration in achieving desirable electromagnetic field fringing behavior in this region concerns the relative size of the radiating element 108 between the points G and H with respect to the gap spacing 248 in this region. A relationship of at least 10 to 1 and preferably 20 to 1 between the G to H dimension of the radiating element 108 and the ground plane spacing 248 at the feed point is desirable.

The polarization and electromagnetic field patterns achieved with the FIG. 1 and 2 antenna are variable in accordance with the relative electrical phasing of the radiating elements 102, 104, 106 and 108 with respect to each other. Preferably these elements are fed with coaxial cable, the grounded conductor of which is connected with the ground plane element 100 internal of the conical base portion—i.e. at each of the fittings 200, 202, and 204. The center conductors of the element feeding four different coaxial cables are connected to the insulated center conductors of the fittings 200, 202, 204 and the fourth not shown fitting of this type in FIG. 2. The distal end of these coaxial cable transmission lines may be connected to a variety of energy source (or sink) associated phasing apparatus, such as 180 degree hybrid couplers or Magic Tees or the 45 degree and 90 degree phasing apparatus described below herein.

Figure 4:
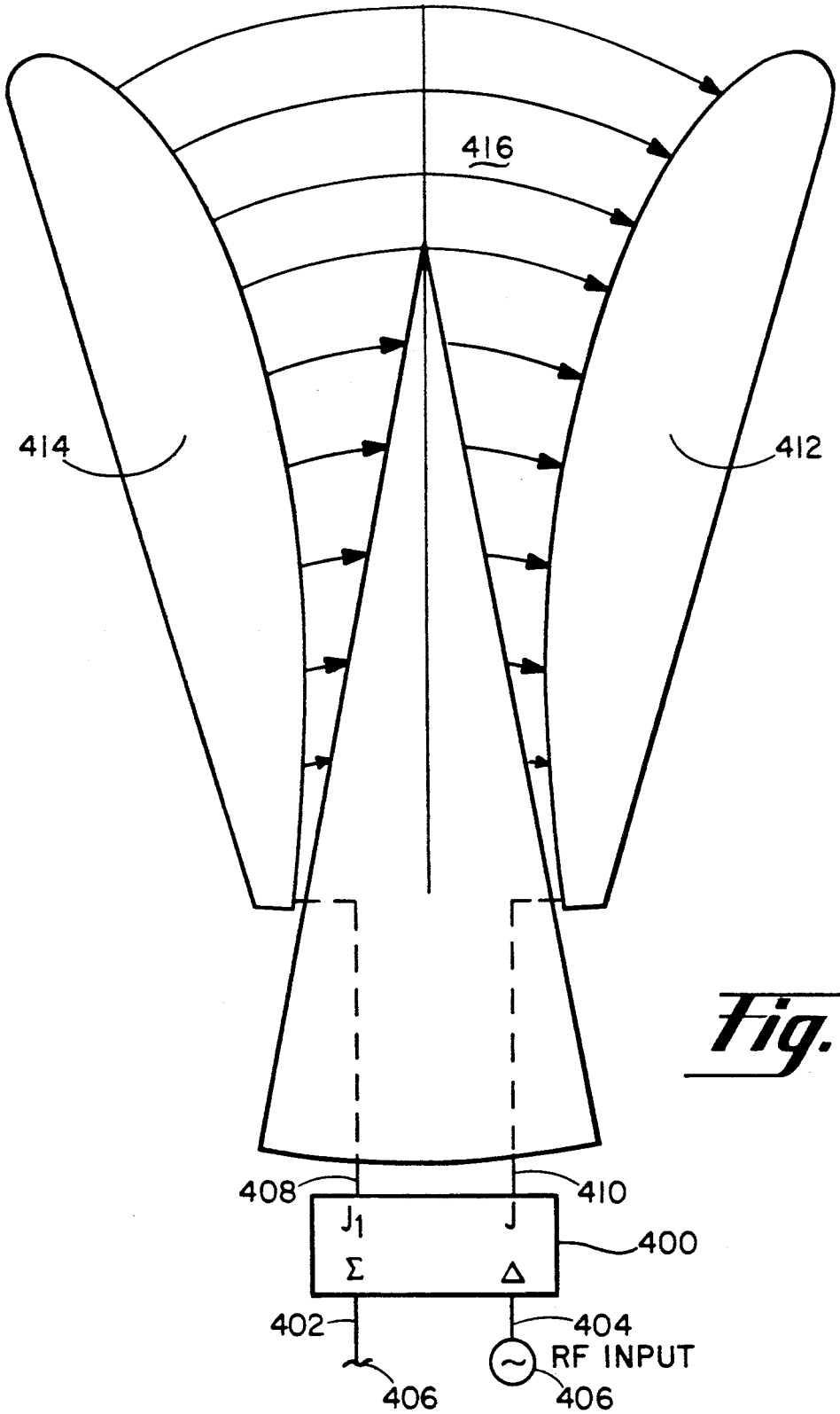
FIG. 4 shows one arrangement for electrical coupling with an antenna according to the invention.
Figure 5:
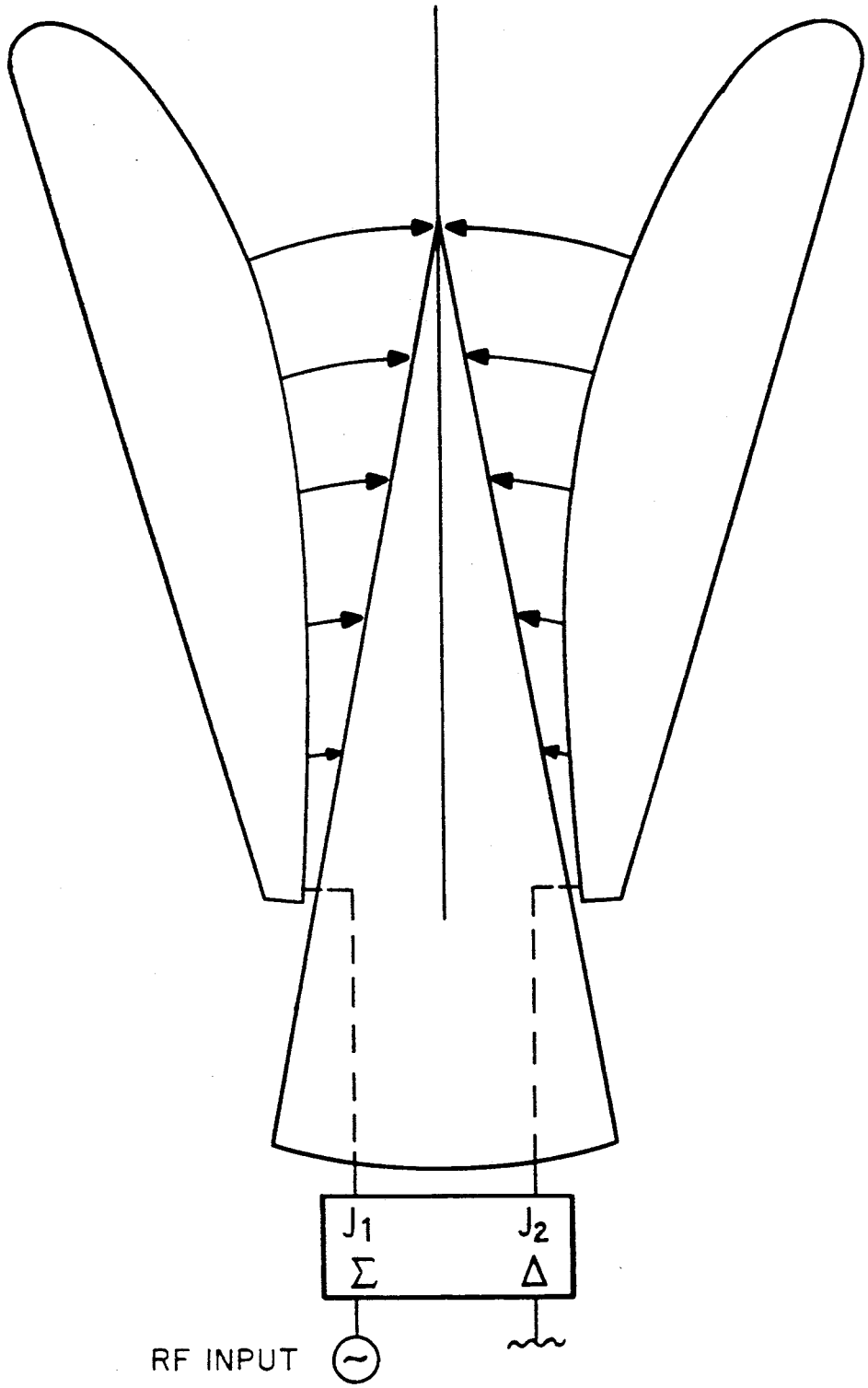
FIG. 5 shows another arrangement for electrical coupling with an antenna according to the invention.
Figure 6:
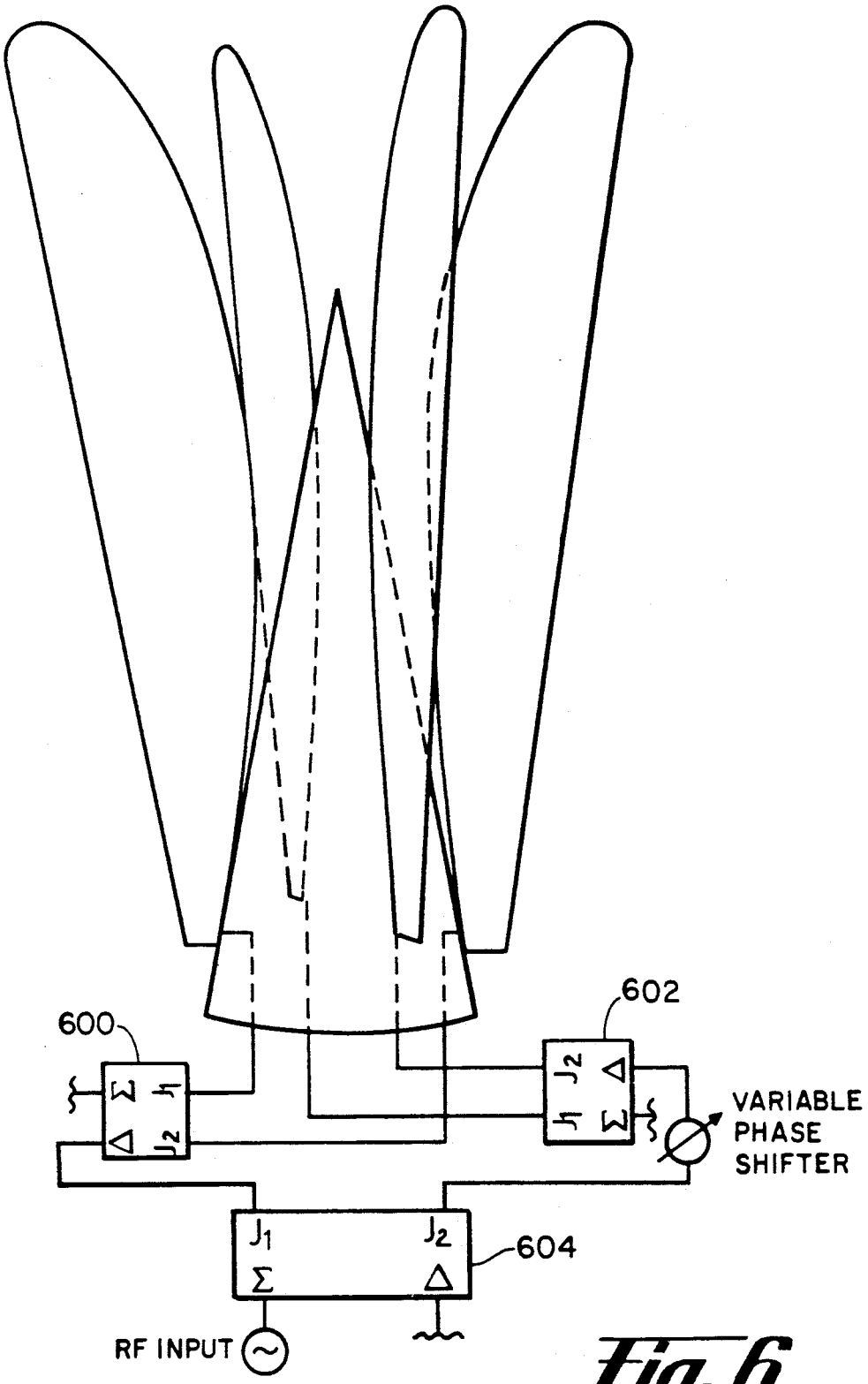
FIG. 6 shows another arrangement for electrical coupling with an antenna according to the invention.
Figure 12:
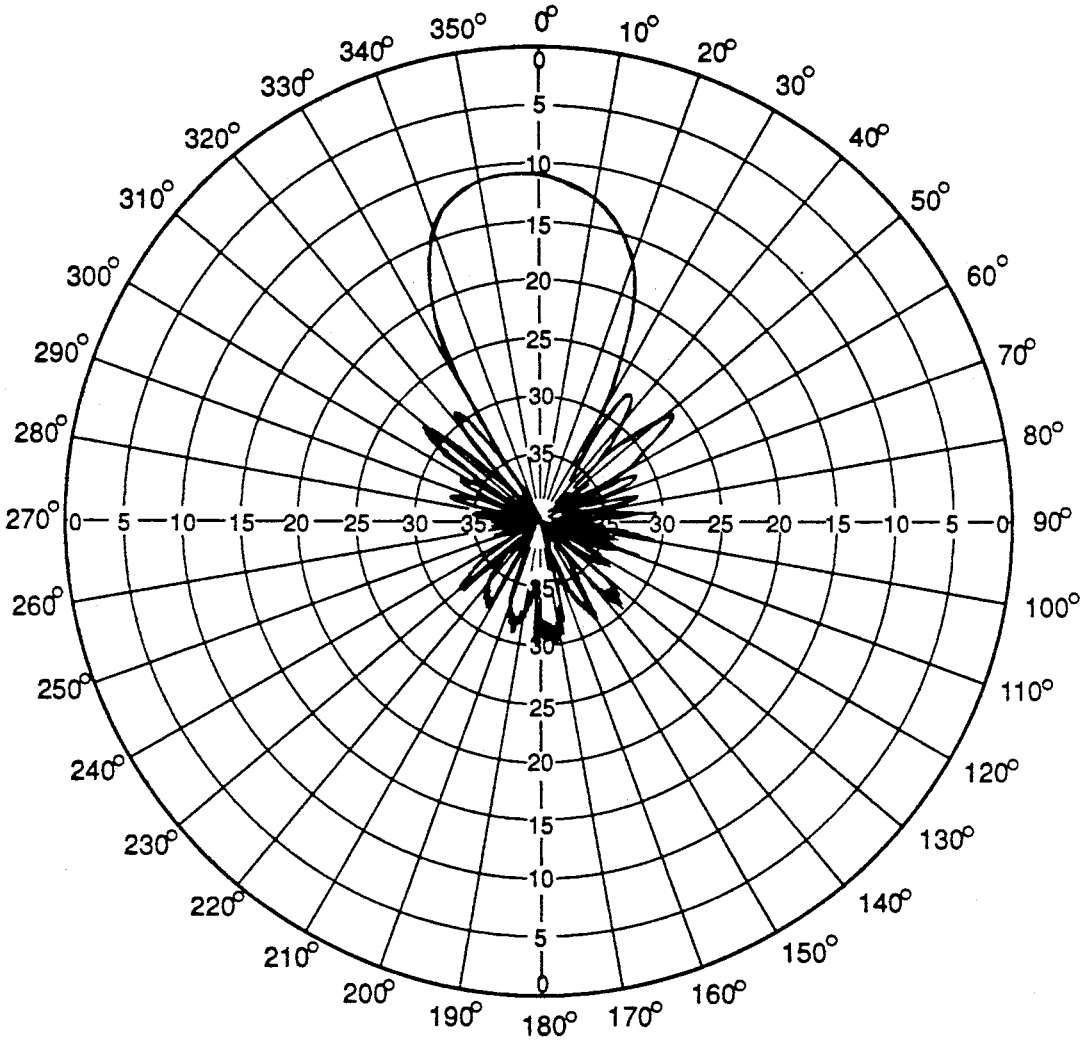
FIG. 12 shows a field pattern for the FIG. 1 antenna when coupled in accordance with the arrangement of FIG. 4.

FIG. 4, 5, and 6 in the drawings show three possible arrangements of this type for coupling radio frequency signals to or from the antenna of FIG. 1 and FIG. 2. In the FIG. 4 drawing, a 180 degree hybrid coupler or a broadband magic T network 400 is used to couple between a radio frequency source or sink 406 and the transmission lines feeding two elements of the FIG. 1 and 2 antenna. According to the FIG. 4 coupling arrangement, the radiating elements 412 and 414 are fed in anti-phase, that is 180 degrees out of phase by way of applying signal to the difference port 404 of the coupler 400 and terminating the summation port in a matched load 402 as is indicated at 406. With this coupling arrangement, the instantaneous electric field between radiating elements 412 and 414 extends from one element to the opposite element as shown at 416. The FIG. 4 coupling arrangement, of course, presumes that the non-shown two elements of the FIG. 1 and 2 antenna are connected in a similar fashion. The field pattern resulting from anti-phase connection of antenna elements as shown in FIG. 4 can be expected to be as illustrated in FIG. 12 when measured at 3 gigahertz.

Figure 13:
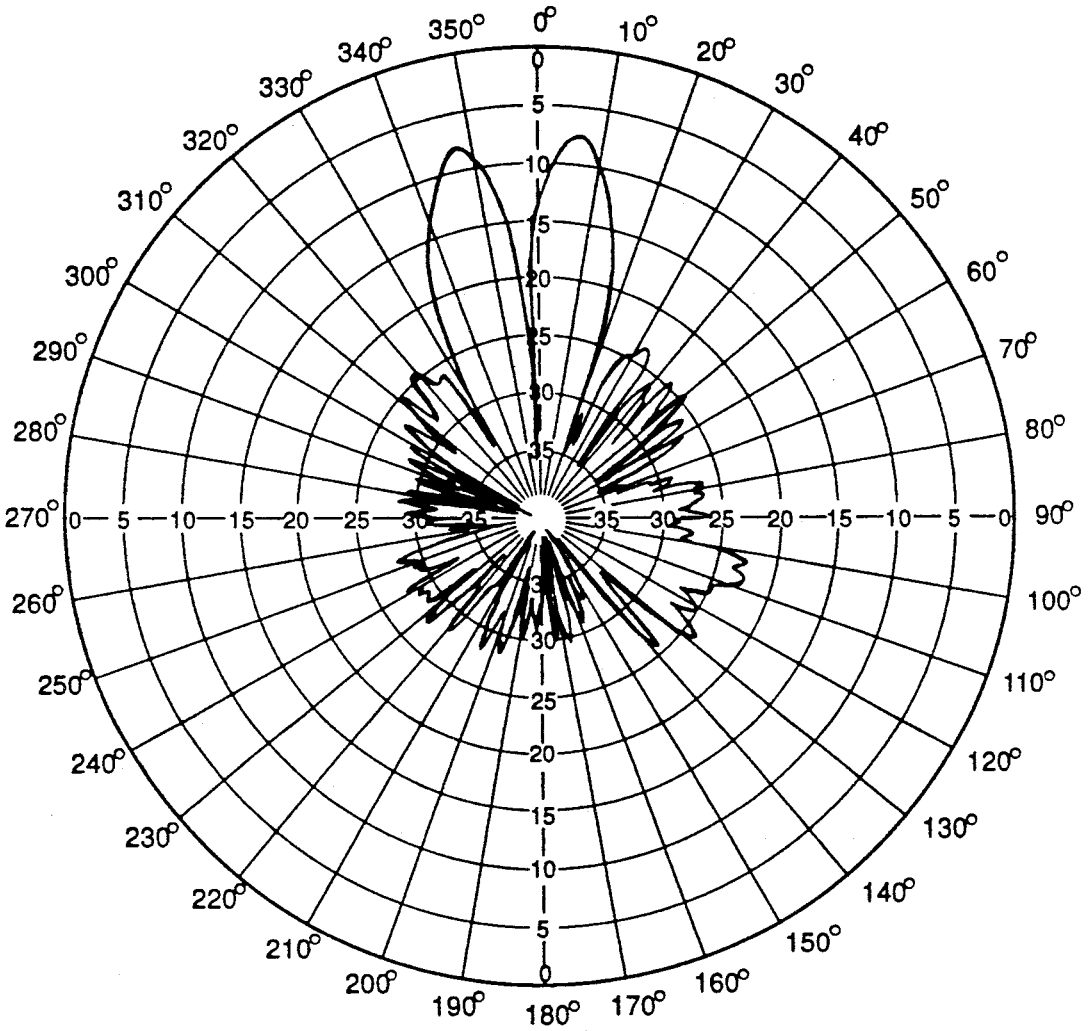
FIG. 13 shows a field pattern for the FIG. 1 antenna when coupled in accordance with the arrangement of FIG. 5.

When the radio frequency input signal to the antenna is applied to a sum port of the 180 degree hybrid coupler or broadband magic T as is shown in FIG. 5 of the drawings, the resulting antenna element electric field extends from both radiating elements to the ground plane cone. In the FIG. 5 coupling arrangement, the remaining two sets of coaxial feed cables are connected to the output ports of a different broadband magic T and in exactly the same fashion as the elements shown in FIG. 5 and therefore result in another field pattern of the FIG. 5 type disposed in a plane perpendicular to the FIG. 5 page. With the connection arrangement thereby described for FIG. 5, the field pattern for the antenna as measured at 8 gigahertz is illustrated in FIG. 13. Good monopulse null and low antenna sidelobes were obtained across the microwave band with this arrangement.

In the FIG. 6, coupling arrangement, two anti-phase signals are applied to the difference ports of two antenna element connected or secondary 180 degree hybrid couplers or broadband magic T networks 600 and 602. In the FIG. 6 feed arrangement, one of the networks 602, is fed with a phase adjustable signal from the primary network 604 in order to control the antenna element phase relationships and the resulting antenna radiation. With the use of variable phase shifting elements, signals of any polarization can be radiated from the antenna of FIGS. 1 and 2. Typical values of phase shift and the resulting polarization are listed below in Table II.

TABLE II

| Achieved Polarization - Antenna with Variable Phase Shifter | |
|---|---|
| Value of Phase Shift | Radiation Polarization |
| 0° | +45° Linear Polarized |
| 45° | Elliptical CW |
| 90° | Circular CW |
| 135° | Elliptical CW |
| 180° | −45° Linear Polarized |
| 225° | Elliptical CCW |
| 270° | Circular CCW |
| 315° | Elliptical CCW |
| 360° | +45° Linear Polarized |

For achieving good sum or main beam patterns and difference or monopulse patterns as well as desirable circular and elliptical polarization performance and desirable VSWR performance in the microwave frequency range, dimensions as shown in the following Table III are desirable for the FIGS. 1 and 2 antenna.

TABLE III

| | |
|---|---|
| Radiating Element Length: | 23 inches |
| Mouth Opening: | 16 inches |
| Radiating Element Thickness: | 0.1 inches |
| Height: | 25 inches |
| Cone Half Angle: | 12.5 degrees |

The antenna of FIGS. 1 and 2 when fabricated according to the parameters of the above table provides the following measured performance:

TABLE IV

| Frequency: | 4 GHz | 6 GHz | 8 GHz |
|---|---|---|---|
| Gain: | 20.3 dB | 24.1 dB | 25.4 dB |
| Beamwidth: | 19° | 12° | 10.5° |
| VSWR: | 1.09:1 | 1.10:1 | 1.11:1 |

Frequency scaling is applicable to the relationship between dimensions and operating frequency for the antenna of FIGS. 1 and 2. A lower frequency performance fall-off which occurs in the range of 0.5 gigahertz for an antenna according to the above recited Table III dimensions will, for example, be increased to a frequency of 1.0 gigahertz by using an antenna having dimensions that are one-half the values recited in this table. In this manner, desirable antenna performance extending into the very high frequency or high frequency bands may be achieved with proportionately increased dimensions from the disclosed antenna.

The antenna of FIGS. 1 and 2 employs four elements; this number of elements is the minimum number needed to achieve all polarization patterns with feed network arrangements of minimum complexity. A three element antenna, for example, might also achieve all polarization but would require a complex or perhaps unrealizable feed network arrangement. The antenna of the present invention is not, however, limited to this three or four element configuration and, in fact, may be readily extended to six or eight or any larger number of elements which can be physically disposed in the available space. The angular separation between adjacent elements of a larger number of elements array requires that such components as the coaxial cable fittings 200–204 in FIG. 2 being limited in physical size and space for the additional phasing network, transmission lines and support structures, be provided.

Figure 7:
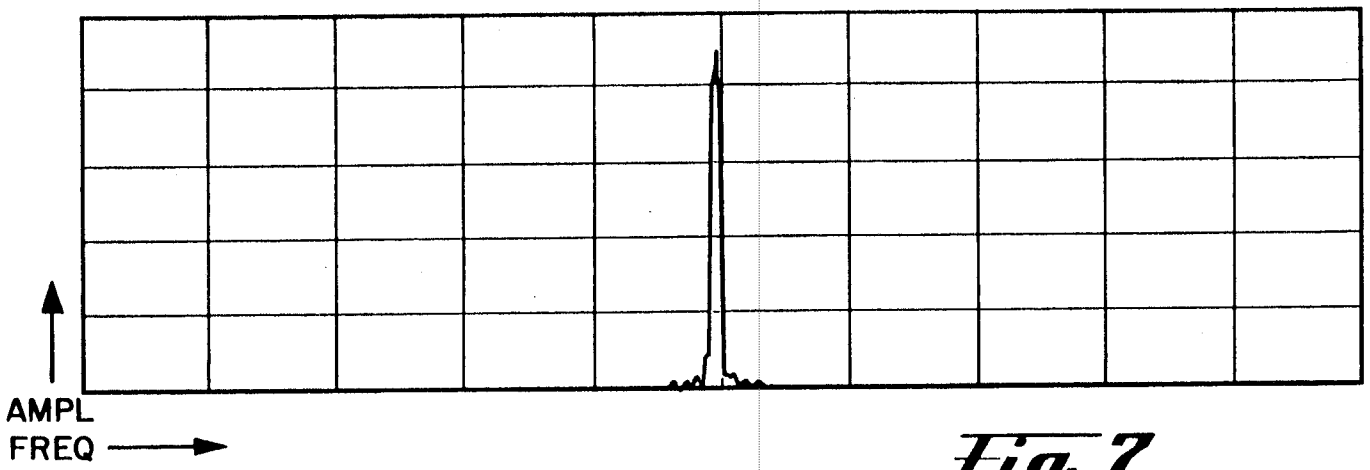
FIG. 7 shows the short pulse response of an antenna made in accordance with the invention.
Figure 8:
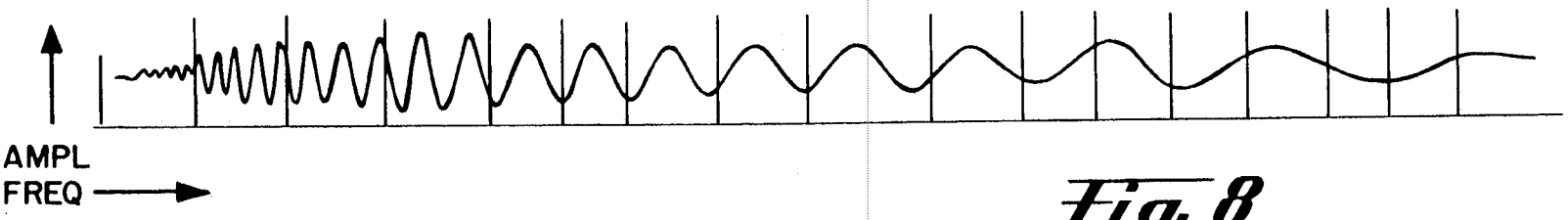
FIG. 8 shows the short pulse response for a prior art antenna.

FIGS. 7 and 8 of the drawings compare the distortion performance of an antenna made in accordance with the present invention, in FIG. 7, with that of a commercially available broadband antenna, in FIG. 8. Each of the antennas in FIGS. 7 and 8 is impressed with a short duration pulse of radio frequency energy, a pulse of 0.2 nanoseconds duration with equal scales of time along the horizontal axis and amplitude along the vertical axis. Clearly, the ringing and distortion of the commercial antenna in FIG. 8 indicate significantly poorer signal fidelity than does the pattern for the antenna of the present invention as shown in FIG. 7. The response of FIG. 7 is, of course, desirable for use with a high resolution radar apparatus since the large instantaneous bandwidth of the applied short duration pulse is radiated and received without incurring measurable distortion. The dispersive characteristics of the FIG. 8 antenna preclude use of such antennas with large instantaneous bandwidth waveforms.

Figure 10:
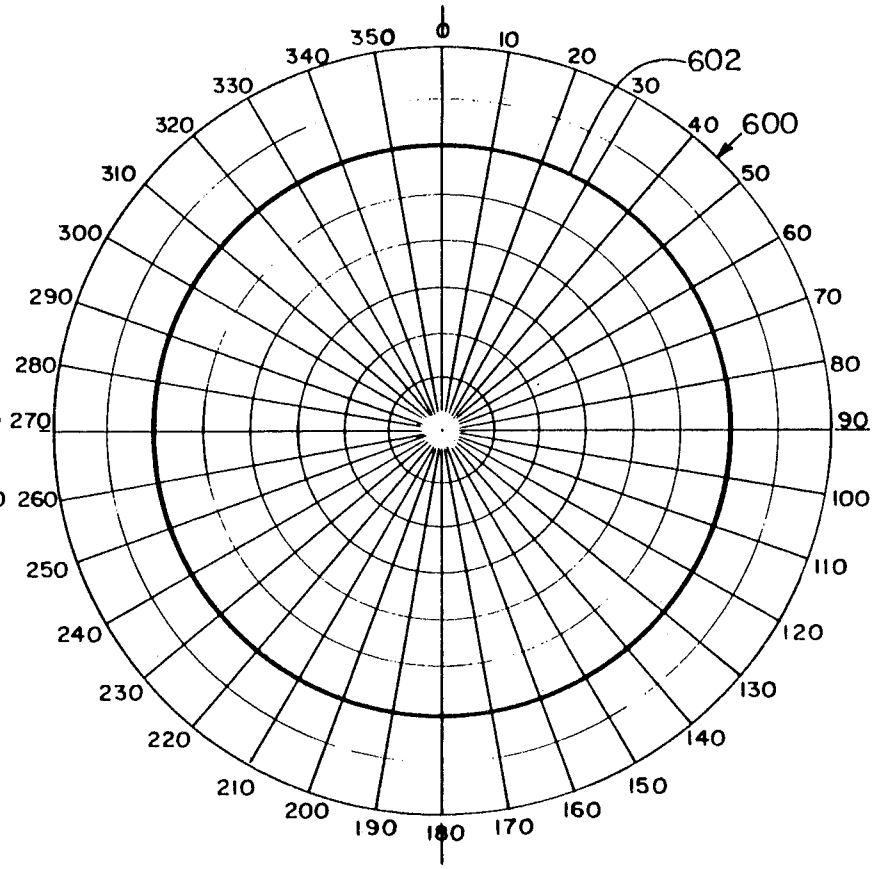
FIG. 10 shows the response of an antenna according to the present invention to a rotating linearly polarized source.
Figure 9:
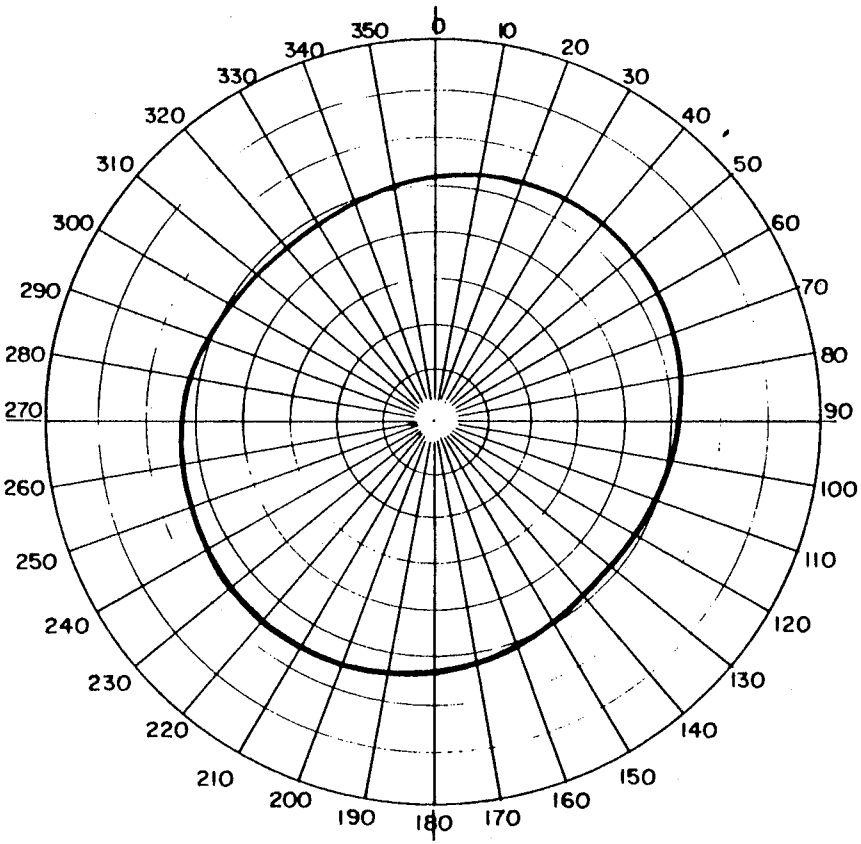
FIG. 9 shows the response of a typical circularly polarized broadband antenna to a rotating linear polarized source.

In a similar manner, FIGS. 9 and 10 of the drawings show the response of a typical circularly polarized broadband antenna to a rotating linearly polarized source in an anechoic test chamber. The response of the typical antenna in FIG. 9 is clearly secondary to the response of the present antenna as shown in FIG. 10. The FIG. 10 response is constant to within limitations of the measuring equipment and indicative of desirable antenna performance.

In addition to the performance indicated by the comparisons of FIGS. 7–10, the antenna of the present invention is found to have desirable collimation between the horizontally and vertically polarized beams over the indicated operating frequency range. Many dual polarized antennas have beam collimation problems, which arise when the horizontally polarized beam points in a different direction than the vertically polarized beam, and may wander about with respect to each other, even over moderate frequency ranges. Examples of this performance have been reported in the literature, especially with respect to military equipment antennas. Measurements made in the antenna disclosed herein show that it has overcome this problem as a result of the described antenna structure and feed arrangement.

The present antenna also provides small monopulse angle tracking error, a characteristic which does not change appreciably with frequency over the entire indicated microwave operating frequency band. This characteristic is used in target detection and tracking. Low angle tracking or pointing direction errors are desirable for present and future radars in which small target tracking capability is needed.

The antenna of the present invention is indicated above to be desirable for laboratory instrument calibration or in-the-field calibration of radar systems in addition to having a number of additional desirable features, advantages, and application.

Among the desirable features and advantages of the invention antenna are the following:

1. The antenna is extremely broadband and is capable of covering, for example, the entire microwave spectrum.
2. The antenna has little or no time (phase) dispersion.
3. The antenna has very low input voltage standing wave ratio (less than 1.1 to 1).
4. The antenna is a nonresonant structure, a contribution to its broadband nature.
5. The antenna is simple to construct and inexpensive to manufacture.
6. The antenna is polarization diverse; it can transmit and receive any polarization including linear, circular, or elliptical.
7. The antenna has desirable phase comparison monopulse response for tracking applications.
8. The antenna is physically small compared to its effective electrical properties.
9. The antenna provides the advantages of items 1 through 8 above all in a single apparatus.

While the apparatus and method herein described constitute a preferred embodiment of the invention, it is to be understood that the invention is not limited to this precise form of apparatus or method, and that changes may be made therein without departing from the scope of the invention, which is defined in the appended claims.

We claim:

1. Antenna apparatus comprising the combination of:

a plurality of radiating elements each resident in one plane of a family of intersecting radiating element planes that are of equal angle spacing about a common plane intersection axis;

each of said radiating elements having an airfoil like cross-section shape in its radiating element plane of residence with the airfoil under surface line in said cross-section shape facing outward and away from said common axis and the airfoil curving most surface line in said cross-section shape facing toward said common axis and lying in predetermined separation therefrom and with the airfoil leading edge portion in said cross-section shape facing a first distal end of said axis and the airfoil trailing edge portion in said cross-section shape facing an opposite second distal end of said axis;

a conically shaped ground plane element disposed centrally of said radiating elements along said axis with an apex portion thereof facing said axis first distal end and a planar base portion thereof facing said axis second distal end;

means for coupling electrical energy signals of predetermined relative phase relationship with each of said radiating elements.

2. The apparatus of claim 1 wherein said plurality of radiating elements consists of four radiating elements.

3. The apparatus of claim 1 wherein said plane intersection axis is vertically disposed.

4. The apparatus of claim 1 wherein the internal surface of said conically shaped ground plane element defines an acute angle with respect to said axis.

5. The apparatus of claim 1 wherein said means for coupling electrical energy signals includes electrical conductor members communicating from the interior region to the exterior region of said ground plane element.

6. A wideband antenna comprising the combination of:

a tapering shaped ground plane element disposed around an antenna central axis with an apex portion thereof facing a first axis extremity and a base portion thereof facing the opposite axis extremity;

a plurality of planar radiating elements disposed in radial planes that are symmetrically distributed about said axis and orthogonally oriented with respect to the surface of said ground plane element;

each of said radiating elements extending along said axis beyond said ground plane apex portion in the direction of said first axis extremity and having a curving cross sectional shape in its plane of residence including predetermined varying separation between the radiating element axis adjacent edge and said ground plane surface.

7. The antenna of claim 6 wherein said predetermined varying separation is in accordance with a mathematical relationship.

8. The antenna of claim 7 wherein said predetermined varying separation is substantially logarithmic in nature.

9. The antenna of claim 8 wherein said tapering shaped ground plane element is conical in shape.

10. The antenna of claim 9 wherein the internal surface of said conically shaped ground place element defines an acute angle with respect to said axis.

11. The antenna of claim 10 further including electrical energy signal transmission means coupled in predetermined electrical phase relationship with each of said radiating elements.

12. The antenna of claim 11 wherein said signal transmission means includes a plurality of electrical conductor members passing through the surface of said ground plane element and connecting with regions of predetermined electrical impedance on each said radiating element.

13. The antenna of claim 12 wherein said regions of predetermined electrical impedance are located at the ground plane base portion adjacent end of each said radiating element.

14. The antenna of claim 6 wherein the largest length dimension of each said antenna element is disposed at a predetermined acute angle opening toward said axis first extremity with respect to the line of said axis.

15. The antenna of claim 6 wherein said length dimension of each said radiating element is selected in response to the frequency band of electrical signals coupled with said antenna.

16. The antenna of claim 15 wherein said length is substantially one-half (½) wavelength at the frequency of low frequency cutoff.

17. The antenna of claim 16 wherein said radiating elements are of identical size and shape and are four in number.

18. The antenna of claim 17 wherein said axis is vertically oriented.

19. The antenna of claim 18 wherein said antenna is received on a physical mounting structure and further including electrically insulating electrical support members connected between a central point of each said antenna blade element and said mounting structure.

20. A method for refining the dimensions of a multiple element horn configured diverse polarization broadband antenna comprising the steps of;

fabricating a first approximation model of the horn configured antenna including the radiating elements, ground plane elements and the predetermined relative positioning and spacing of said elements, said fabricating including selecting element and spacing dimensions adjacent to the element feed point to achieve a predetermined input first surge impedance value;

coupling said first approximation antenna through a coaxial transmission line of said predetermined first impedance value to a time domain reflectometer surge impedance determining apparatus;

adjusting the physical size of the radiating elements and the relative spacing thereof with respect to said ground plane member and with respect to each other to achieve linear smoothly increasing values of surge impedance along the length of the radiating elements;

said linear increasing surge impedance values including a predetermined moderate final value of surge impedance at an antenna horn mouth disposed point.

21. The method of claim 20 wherein said predetermined moderate final value of surge impedance defines a horn mouth radius large enough to provide a moderately sloped horn surface of low energy reflection back to the element feed region of said horn and small enough to limit the overall size of said horn within predetermined moderate limits.

22. The method of claim 21 wherein said predetermined input first surge impedance value is fifty ohms and wherein said predetermined moderate final value of surge impedance is between one hundred thirty and two hundred thirty ohms.

23. The method of claim 22 wherein said first approximation model includes spacing between each of said elements and said ground plane element that opens exponentially in proceeding from throat to mouth regions of said horn.

* * * * *